United States Patent [19]

Kamon et al.

[11] Patent Number: 4,646,872

[45] Date of Patent: Mar. 3, 1987

[54] EARPHONE

[75] Inventors: Yoshiyuki Kamon, Kanagawa; Makoto Yamagishi; Shingo Watanabe, both of Tokyo, all of Japan

[73] Assignee: Sony Corporation, Tokyo, Japan

[21] Appl. No.: 793,090

[22] Filed: Oct. 30, 1985

[51] Int. Cl.[4] ..... H04R 25/00

[52] U.S. Cl. ..... 181/129; 181/149; 387/158; 387/187

[58] Field of Search ..... 181/129, 130, 20, 22, 181/135, 132, 149; 179/156 R, 182 R, 182 A, 180, 179

[56] References Cited

U.S. PATENT DOCUMENTS

| | | | |
|---|---|---|---|
| 3,586,794 | 6/1971 | Michaelis | 181/129 X |
| 4,005,278 | 1/1977 | Gorke | 179/180 X |
| 4,441,576 | 4/1984 | Allen | 181/135 X |

*Primary Examiner*—Benjamin R. Fuller

*Attorney, Agent, or Firm*—Hill, Van Santen, Steadman & Simpson

[57] ABSTRACT

An earphone having a housing, a speaker unit accommodated in the housing and a duct formed in the housing to pass sound emanated from the rear surface of the speaker unit and in which a mesh subjected to water repellent treatment is provided within the duct.

4 Claims, 7 Drawing Figures

EARPHONE

BACKGROUND OF THE INVENTION

1. Field of the Invention

This invention generally relates to an earphone and more particularly, is directed to a compact earphone which is adapted to be engaged with and attached to a cavum of a concave portion in an auricle during operation.

2. Description of the Prior Art

The low frequency range reproduction limit of a prior art open air-type earphone is mainly determined by a compliance Cmd (reciprocal number of stiffness S) of a vibration system and an equivalent mass Md of the vibration system. In this case, the response in the low frequency range in which the lowest resonance frequency is lower than $f_o$ is lowered. In general, the resonance frequency $f_o$ is substantially given as $$f_o = \tfrac{1}{2}\pi \sqrt{Md \cdot Cmd}$$

In order to make the resonance frequency $f_o$ low, the compliance Cmd (cm/dyne) of the vibration system must be made high and/or the equivalent mass Md (gram) thereof must be increased. There is, however, a limit in increasing the compliance Cmd. Further, if the equivalent mass Md of the vibration system is increased, the auditory sensitivity becomes low and the acoustic characteristic in the high frequency range is deteriorated etc. Accordingly, there is naturally a limit in increasing the equivalent mass Md.

As is known, since there is a tendency that the lowest resonance frequency $f_o$ becomes higher as the diameter of the speaker unit becomes smaller, it is recognized that reproduced sound in a low frequency range is not heard by those who use an earphone of small diameter.

For instance, in the earphone which is disclosed in European patent publication No. 0064553, a magnetic circuit is formed of a magnet of a disc-shape, a cylindrical yoke and a plate surrounding the magnet. A diaphragm is coupled to a voice coil that is inserted into the air gap of the magnetic circuit and is incorporated in the front portion thereof to form a speaker unit. The outer peripheral portion of the speaker unit is mounted to a housing. At the rear surface of through-holes formed through the outer peripheral portion of the speaker unit, there is provided a samping layer and through-holes are formed through the housing to thereby control the frequency characteristic.

In other words, the acoustic circuit of this prior structure is expressed by a series circuit formed of an equivalent mass Md of the vibration system, a compliance Cmd thereof, an acoustic resistance Rd, a signal source Vs and an acoustic resistance Ra provided by the damping layer or the like, and a parallel circuit connected to the series circuit and formed of an acoustic resistance Rb by the through-hole of the housing and the compliance Cb by the back cavity.

However, since the acoustic resistance Rb provided by the through-holes of the housing is neglibibly small as compared with the acoustic resistance Ra of the damping layer or the like and the compliance Cb can be also neglected substantially, the effects of the acoustic resistance Rb and the compliance Cb constituting the parallel circuit are small, and thus the acoustic circuit substantially becomes a series resonance circuit formed of the equivalent mass Md, the compliance Cmd and the acoustic resonances Rd and Ra. Accordingly, the lowest resonance frequency $f_o$ is substantially given as $$f_o = \tfrac{1}{2}\pi \sqrt{Md \cdot Cmd}$$

and it becomes difficult to set the frequency $f_o$ low.

Further, if the acoustic resistance Ra is small, a peak of acoustic characteristic is produced near the lowest resonance frequency $f_o$ so that only the nearby sound is emphasized and becomes a resonant sound, whereas if the acoustic resistance Ra is large, the acoustic characteristic is lowered from the frequency higher than the lowest resonance frequency $f_o$ so that the reproduction of low frequency range becomes insufficient.

OBJECTS AND SUMMARY OF THE INVENTION

Accordingly, it is an object of this invention to provide an earphone in which without modifying a speaker unit, an acoustic circuit provided at the rear surface of the speaker unit is devised to improve the frequency characteristic at the low frequency range.

It is another object of this invention to provide an earphone in which, as means for improving the reproduction of low freqency range, a duct is formed in communication with the housing of an earphone and is used to pass the sound emanated from the rear surface of the speaker unit to the outside, and water repellent means is provided within the duct so that even if the earphone is submerged into water, the original acoustic characteristic of the earphone can be rapidly recovered after it is removed from the water.

It is a further object of this invention to provide an earphone of a simple construction in which the lowest resonance frequency can be set at a low frequency and which can be used as an all weather earphone in the outdoors.

These and other objects, features and advantages of the earphone according to the present invention will become apparent from the following detailed description of the preferred embodiment taken in conjunction with the accompanying drawings, throughout which like reference numerals designate like elements and parts.

DESCRIPTION OF THE PREFERRED EMBODIMENT

Figure 1:
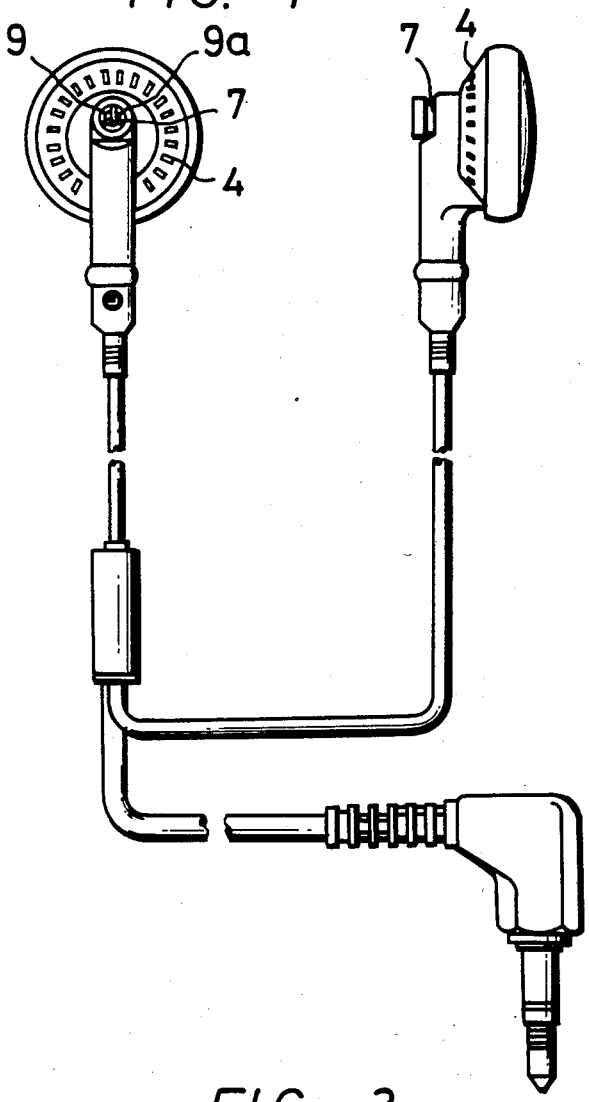
FIG. 1 is an assembly view illustrating the present invention applied to a stereo earphone system.
Figure 2:
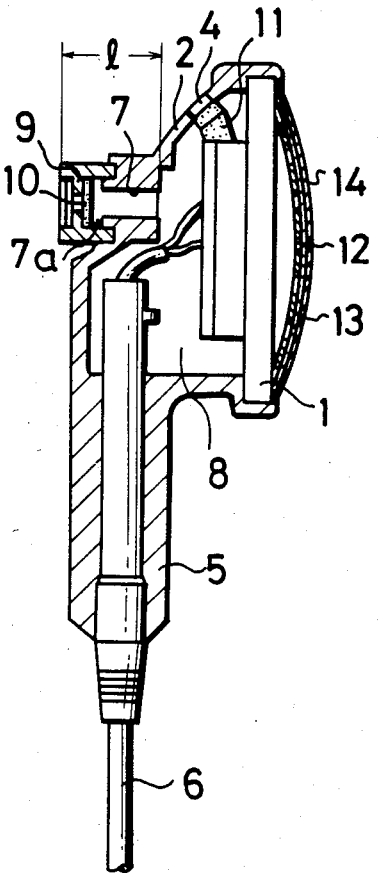
FIG. 2 is an enlarged cross-sectional view showing an embodiment of the earphone according to this invention.

An embodiment of an earphone according to this invention will be described hereinafter with reference to the attached drawings. As shown, the earphone of this invention is used to form, for example, a stereo earphone as shown in FIG. 1. FIG. 2 is an enlarged cross-sectional view showing the main body of such earphone. Referring to FIG. 2, the earphone itself will be described. In this embodiment, a speaker unit 1 is accommodated and fixed in a housing 2 of substantially frusto-conical-shape, and within the housing 2 at the rear portion of this speaker unit 1, there is formed a predetermined back cavity 8. A duct 7, which is acoustically coupled to the back cavity 8, and having an opening *7a* is formed integrally with the housing 2. The opening *7a* of the duct 7 is covered with a housing cap 9 having a grid of, for example, Y-shape. The grid of Y-shape provides the housing cap 9 with an opening *9a* (refer to FIG. 1).

At the inside of the housing cap 9 which covers the opening *7a* of the duct 7, there is provided a mesh 10 made of stainless steel of 100 to 200 meshes per inch having a relatively good ventilation property and which is subjected to a water repellent treatment such as a fluorine treatment or silicone treatment. It is also possible to provide such mesh 10 in the ducts 7. Further, through the housing 2 at its portion corresponding to the outer peripheral portion of the back cavity 8 there are formed a large number of through-holes 4 which serve to communicate between the inside and the outside of the housing 2. In this embodiment, at the inside of the through-holes 4 that are formed through the housing 2 there is provided a damping filter 11 which is made, for example, of a water repellent nylon screen and a material into which urethane resin as a damping material is polymerized.

Further, at the front of the speaker unit 1, there is provided a grille 12 made of a metal plate which has a large number of openings through which the sound emanated from the diaphragm of the speaker unit 1 is passed. At the front side of this grille 12, there are laminated a water repellent urethane resin 13 which is used as a damping material and a grille screen 14. In FIG. 2, reference numeral 5 designates a cord holder and 6 a cord supported by the code holder 5. Upon usage, the housing 2 of the earphone is inserted into the auricle.

Figure 3:
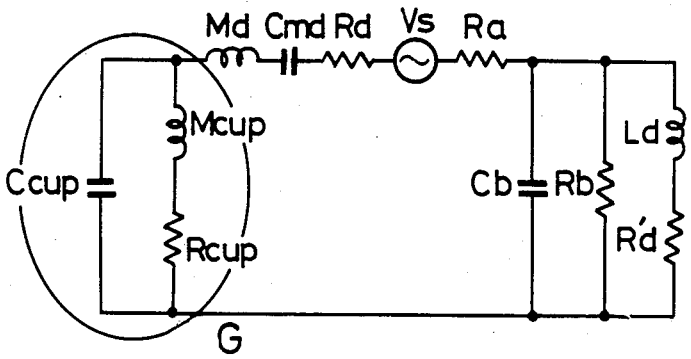
FIG. 3 is a diagram showing an acoustic equivalent circuit of FIG. 2.
Figure 4:
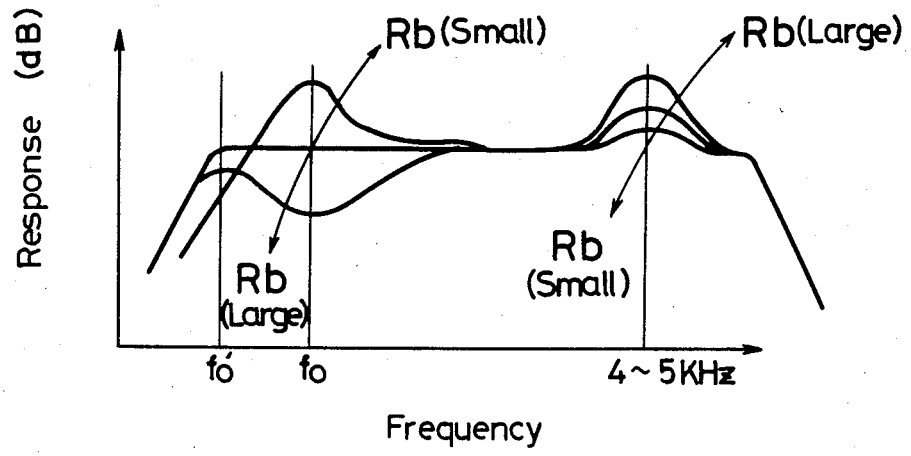
FIGS. 4 to 7 are respectively frequency vs. response characteristic graphs useful for explaining the present invention.

The acoustic equivalent circuit of the earphone of such structure when it is inserted into the auricle becomes as shown in FIG. 3. In FIG. 3, reference letters Md, Cmd and Rd designate an equivalent mass, a compliance and an acoustic resistance of the vibration system of the speaker unit 1, respectively. Reference letter Ra designates an acoustic resistance provided by the openings or the like formed at the outer peripheral portion of the speaker unit 1 and in this case, Ra=0 is established substantially. Reference letter Vs deignates a signal source. Mcup, Ccup and Rcup encircled by a circle G respectively designate an equivalent mass, a compliance and an acoustic resistance of a coupler used when the earphone is measured. Further, reference letter Cb designates a compliance presented by the back cavity when the housing 2 is formed as a frustoconical shape; reference letter Rb is an acoustic resistance presented by the urethane resin 13 used as the damping material; and reference letters Ld and R'd an inductance (mass) and an acoustic resistance presented by the duct 7. In this case, the acoustic resistance R'd is very snmall, Accordingly, the damping at the rear surface of the diaphragm of the earphone becomes a parallel resonance circuit formed of the acoustic resistance Ld, the compliance Cb and the acoustic resistance Rd. This circuit is added to the series resonance circuit formed of the equivalent mass Md, the compliance Cmd and the acoustic resistance Rd. Accordingly, as shown in FIG. 4, the lowest resonance frequency on the whole of the acoustic circuit of the earphone is decreased by the inductance (mass) Ld of the duct 7 so as to become a frequency $f_o$ lower than the lowests resonance frequency $f_o$ of the speaker unit 1 itself. Similarly, as shown in FIG. 4, the acoustic resistance Rb, which is in parallel to the acoustic resistance Ld, is made small,the frequency $f_o$ becomes high, whereas if the acoustic resistance Rb is made large, the middle frequency range becomes low. Consequently, it is necessary to select the acoustic resistance Rb to be a proper value relative to the acoustic resistance Ld.

With respect to the high frequency range, if the acoustic resistance Rb is made large, the level in a high frequency range necessary for the reproduction by the headphone can be increased in view of the auditory sense.

As will be clear from the above-described results, if the length of the duct 7, and/or the member 11 made of urethane resin as the damping material are varied, it is possible to carry out the acoustic control.

Figure 5:
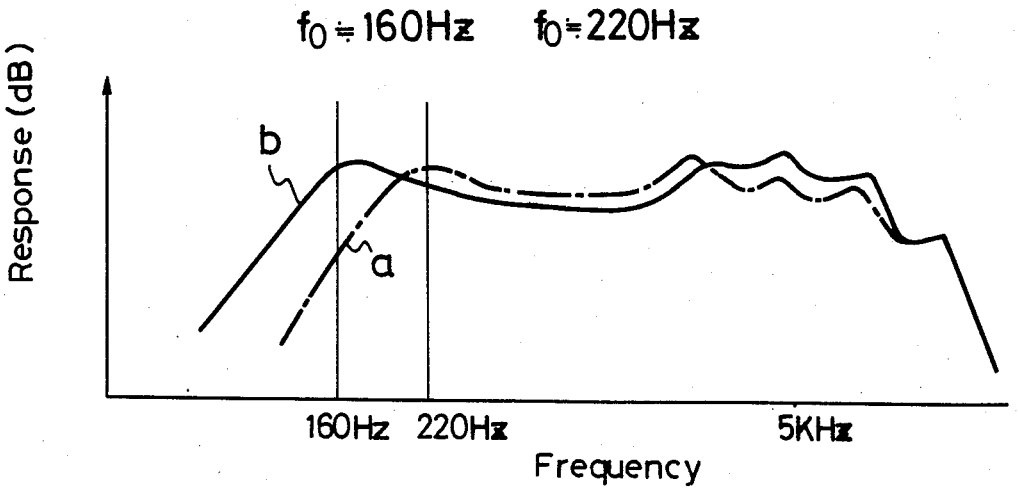

FIG. 5 is a graph showing results of comparing the response vs. frequency charactistic a of the prior art earphone and the response vs. frequency characteristic b of the earphone having the duct of 2 mm (in diameter) ×6 mm (in length) according to this invention. From this graph of FIG. 5, it will be seen that the lowest resonance frequency $f_o$ is lowered from 220 Hz to 160 Hz and also it will be seen that the level in the high frequency range near 2 to 6 kHz necessary for the headphone reproduction is increased. In this case, the speaker unit 1 is 16 mm in diameter.

Figure 6:
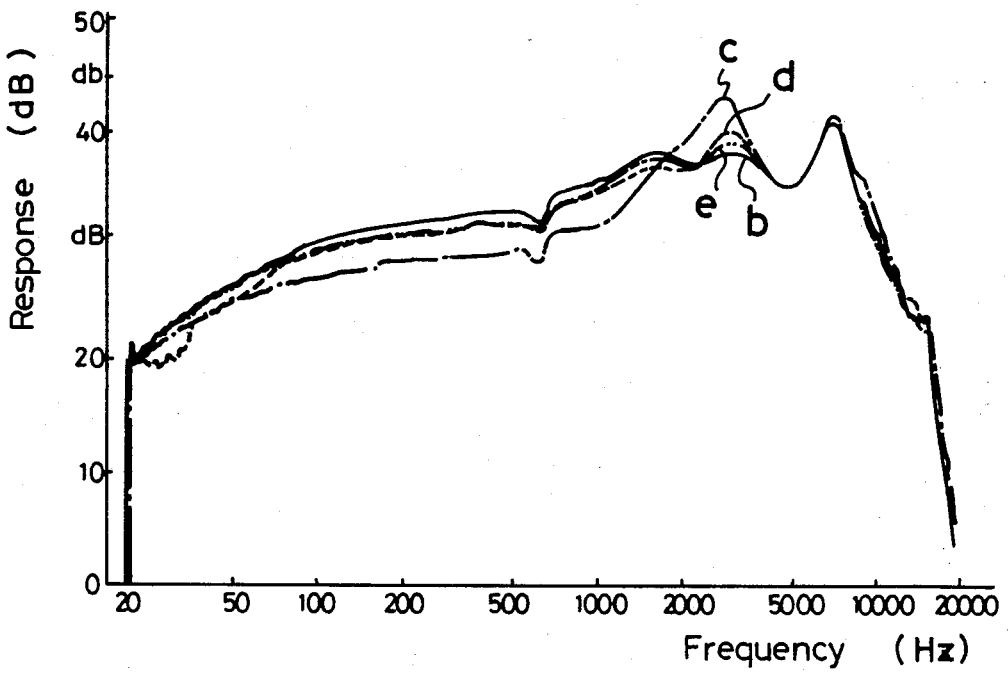

Further, after the earphone was submerged into the water, for example at 15 cm deep for one minute, the water in the earphone was wiped out by a cloth and the acoustic characteristic thereof was measured. The measured results are shown on a graph of FIG. 6. As shown in the graph of FIG. 6, it can be understood that the original acoustic characteristic of the earphone is recovered after about 5 to 10 minutes following removal from the water. In the graph of FIG. 6, a curve b indicates the acoustic chacteristic presented before the earphone is submerged into the water, a curve c the acoustic characteristic presented when the water in the earphone was wiped out by the cloth, a curve d the acoustic characteristic presented 5 minutes after the water in the earphone was siped out and a curve e the acoustic characteristic presented 10 minutes after the water in the earphone was wiped out.

Figure 7:
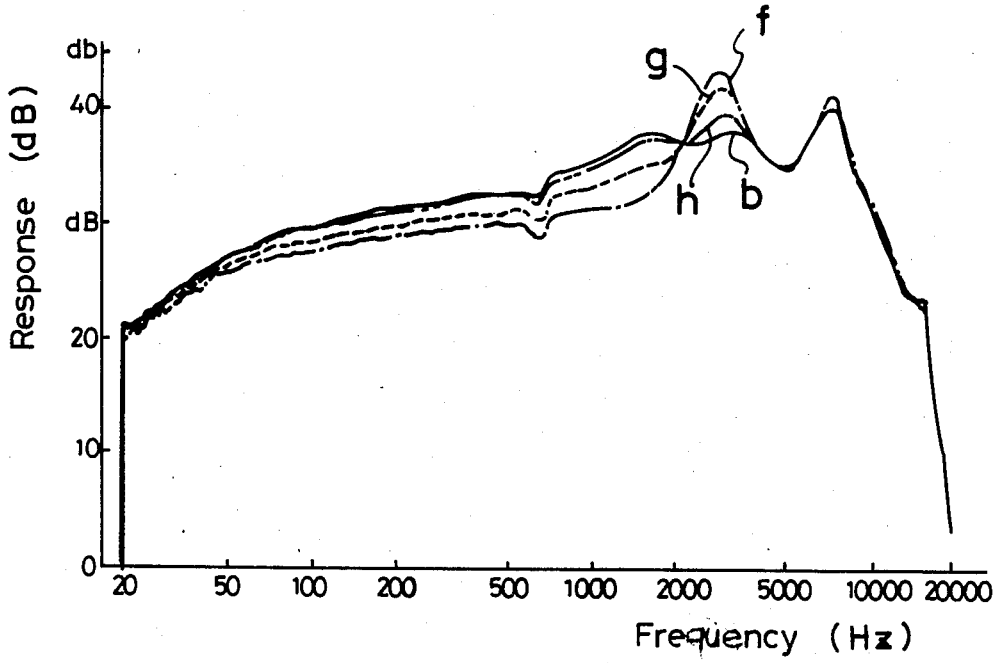

Furthermore, the earphone of this invention was set in an ear model and was subjected to the water shower for thirty seconds. Then, the water in the earphone was wiped out by the cloth and the acoustic characteristic thereof was measured. The measured results are shown on a graph of FIG. 7. As shown in FIG. 7, the original acoustic characteristic of the earphone is substantially recovered after about thirty minutes to one hour from the wiping of the water. In the graph of FIG. 7, a curve b indicates the original acoustic characteistic and the acoustic characteristic presented just after one hour, a curve f the characteristic presented when the water in the earphone is wiped out by the cloth, a curve g the acoustic characteristic presented after 10 minutes since the water in the earphone was wiped out and a curve b the acoustic characteristic presented 30 minutes after the water in the earphone was wiped out by the cloth.

As set forth above, according to the earphone of this invention, since the opening portion *7a* of the duct 7, the member 11, the urethane resin 13 provided in the front of the grille 12 and the grille screen 14 are subjected to the water repellent treatment, there is then an advantage that when the earphone of the present invention is surbmerged into water, its original acoustic characteristic will be recovered rapidly.

As described above, according to the present invention, since the duct 7 is provided in connection with the housing 2 to pass therethrough the sound emanaged from the rear surface of the speaker unit 1, the lowest resonance frequency on the whole of the acoustic equivalent circuit is decreased by the inductance (mass) of the duct to the frequency lower than the lowest resonance frequency of the speaker unit 1 itself, while with the respect to the high frequency range, the level in the high frequency range is increased by the resonance of the compliance by the back cavity 8 and the equivalent mass of the virbration system so that the response in the low frequency range and the response in the high frequency range can both be improved.

Furthermore, since the duct 7 and the like are subjected to the water repellent treatment, the water can be prevented from entering through the duct 7 and the like so that even when this earphone is submerged into water, the original acoustic acoustic characteristic of the earphone will be recovered rapidly.

The above description relates to a preferred embodiment of the invention but it will be apparent that many modifications and variations can be effected by one skilled in the art without departing from the spirit or scope of the novel concepts of the invention, so that the scope of the invention should be determined by the appended claims only.

We claim as our invention:

1. An earphone comprising:

a housing having a front facing opening, a speaker unit having front and rear portions mounted in said housing with the front of the speaker positioned in said opening;

a back cavity in said housing formed between a rear portion of said speaker unit and said housing, and a duct acoustically coupled to said back cavity to imprive the lowest resonance frequency, said duct comprising an opening through said housing by which said back cavity and the rear outside of said housing communicate with each other, said duct being provided with a mesh thereacross which passes acoustical sounds but limits passage of water.

2. An earphone according to claim 1 in which said mesh is treated with a water repellent.

3. An earphone according to claim 1 or 2 in which said mesh is of 100 to 200 meshes per inch.

4. An earphone according to claim 1 including a further plurality of rear facing openings in said housing adjacent the periphery of the speaker unit communicating with the rear outside of the housing, each of said rear facing openings having water repellent acoustics damping means positioned therein.

* * * * *